US006050400A

United States Patent [19]

Taskis et al.

[11] Patent Number: 6,050,400

[45] Date of Patent: Apr. 18, 2000

[54] PACKAGE

[75] Inventors: Charles Bernard Taskis; Paul John Whatmore, both of Worthing, United Kingdom

[73] Assignee: SmithKline Beecham PLC, Brentford, United Kingdom

[21] Appl. No.: 08/750,612

[22] PCT Filed: Jun. 6, 1995

[86] PCT No.: PCT/EP95/02201

§ 371 Date: Dec. 10, 1996

§ 102(e) Date: Dec. 10, 1996

[87] PCT Pub. No.: WO95/34488

PCT Pub. Date: Dec. 21, 1995

[30] Foreign Application Priority Data

Jun. 10, 1994 [GB] United Kingdom ..... 9411626

[51] Int. Cl.[7] ..... B65D 81/26

[52] U.S. Cl. ..... 206/204; 206/459.1; 206/438; 206/467

[58] Field of Search ..... 206/204, 438, 206/461, 467, 459.1, 484, 484.2, 364, 484.1, 471; 215/247, 249; 53/471, 476, 478

[56] References Cited

U.S. PATENT DOCUMENTS

| | | | |
|---|---|---|---|
| 2,283,867 | 5/1942 | Flosdorf et al. . | |
| 2,812,231 | 11/1957 | Zar . | |
| 4,205,754 | 6/1980 | Nielsen et al. | 215/249 |
| 4,398,491 | 8/1983 | Fridl et al. | 206/459.1 |
| 4,441,609 | 4/1984 | Crowley . | |
| 4,449,631 | 5/1984 | Levenberg et al. | 206/459.1 |
| 4,678,083 | 7/1987 | Anderson | 206/459.1 |
| 4,813,541 | 3/1989 | Velasco et al. | 206/459.1 |
| 4,816,305 | 3/1989 | Stillwell et al. | 206/459.1 |
| 4,863,915 | 9/1989 | Ward | 514/197 |
| 5,051,360 | 9/1991 | Waters | 206/459.1 |
| 5,052,558 | 10/1991 | Carter | 206/471 |

FOREIGN PATENT DOCUMENTS

| | | |
|---|---|---|
| 0 131 147 | 1/1985 | European Pat. Off. . |
| 0 488 323 A1 | 6/1992 | European Pat. Off. . |
| 0 597 097 A1 | 5/1994 | European Pat. Off. . |
| 1485832 | 9/1977 | United Kingdom . |
| 2208287 | 3/1989 | United Kingdom . |

*Primary Examiner*—Paul T. Sewell
*Assistant Examiner*—Luan K. Bui
*Attorney, Agent, or Firm*—Dara L. Dinner; Stephen Venetianer; Charles M Kinzig

[57] ABSTRACT

A package comprising a vial (1) provided with a puncturable seal (2), or a syringe or syringe barrel, being permeable to water vapor but impermeable to liquid water, enclosed within an outer container which is less permeable to water vapour, the intermediate space between the inner and outer containers containing a desiccent (10).

16 Claims, 1 Drawing Sheet

PACKAGE

FIELD OF THE INVENTION

This invention relates to packages, particularly to packages for moisture sensitive pharmaceutical substances.

BACKGROUND OF THE INVENTION

It is normal practice with moisture sensitive pharmaceutical materials intended for parenteral use to package such materials in a glass vial with a rubber stopper to minimise moisture ingress and maintain product stability. Plastics material vials are sometimes required for a product where the high pH of the reconstituted solution may attack glass, but in general they are to be avoided because even the best are permeable to water vapour to some extent, and result in a shorter shelf life. Although careful control of the manufacturing and processing conditions may reduce the product moisture content to acceptable levels, there are times when this will not be sufficient, and some form of desiccation would be required. While this is fairly straightforward for oral dosage forms by the inclusion of desiccants in the pack, etc. the demands for sterility in a parenteral product mean that this approach cannot be used.

An example of a moisture sensitive pharmaceutical substance is a pharmaceutically acceptable derivative of the β-lactamase inhibitor clavulanic acid, such as potassium clavulanate. Potassium clavulanate is both hygroscopic and readily hydrolysed by water, so for handling and long term storage of potassium clavulanate it is necessary for the immediate environment to be kept dry, e.g. 30% Relative Humidity ("RH") or less, preferably 10% RH or less.

Potassium clavulanate is a β-lactamase inhibitor, and is often provided in a formulation in combination with a partner β-lactam antibiotic. A partner which is often used in injectable formulations is amoxycillin in the form of sodium amoxycillin. Sodium amoxycillin is often used in such formulations in the form of spray-dried sodium amoxycillin, which is a powerful desiccant, and when contained together with potassium clavulanate in a sealed vial such forms of sodium amoxycillin can exert a dehydrating effect which helps to preserve the potassium clavulanate. Other forms of sodium amoxycillin, such as the anhydrous crystalline form disclosed in EP 0131147 are less desiccating, and although it would be desirable to use such forms in formulations together with potassium clavulanate because of the inherent greater purity of the crystalline form, the problem arises that these forms can be insufficiently desiccating to protect the potassium clavulanate.

Packaging systems are known which can desiccate tablets and capsules for swallowing by a patient. For example FR 2660634A discloses a blister pack for tablets in which two blisters are arranged side by side with an interconnecting channel. One of the blisters contains the tablet and the other a desiccant material to desiccate the tablet. EP 0466068A discloses a similar arrangement in which a capsule is desiccated.

It is an object of this invention to provide a desiccating package which inter alia is suitable for use with moisture sensitive pharmaceutical substances and allows sterile dissolution for parenteral administration without the problem of contamination by desiccant. Other objects and advantages of the invention will be apparent from the following description.

SUMMARY OF THE INVENTION

This invention provides a package which comprises an inner container suitable for containment of a pharmaceutical formulation, the inner container being enclosed within an outer container which is substantially less permeable to water vapour than the inner container, the intermediate space between the inner and outer containers containing a desiccant, characterised in that the said inner container is a vial provided with a puncturable seal, or a syringe or syringe barrel, suitable for use for transdermal injection of a formulation, and being permeable to water vapour but impermeable to liquid water.

DETAILED DESCRIPTION OF THE INVENTION

Figure 1:
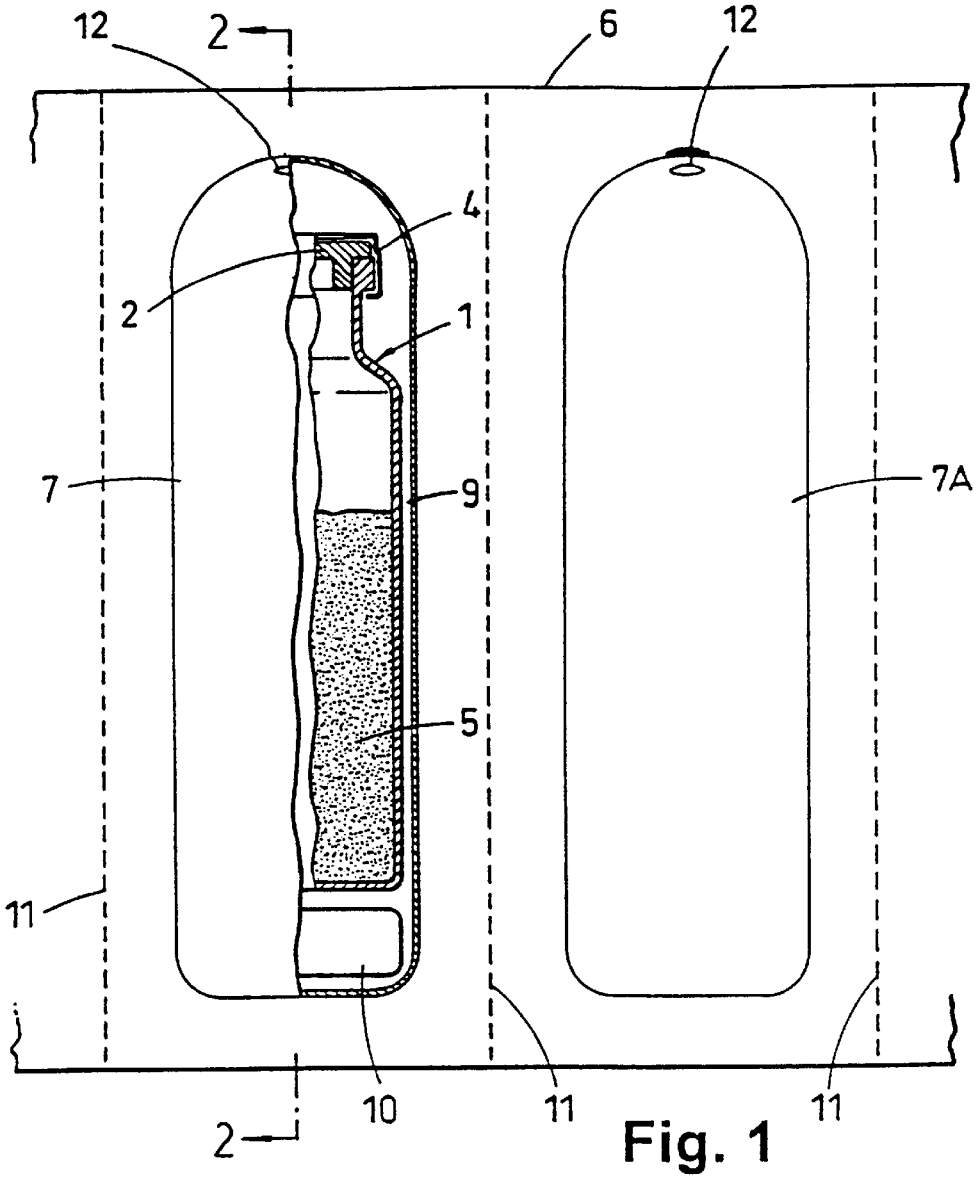
FIG. 1 shows a partial cut away view a package of the invention in the form of a blister pack.

In the package of the invention, moisture is gradually extracted from the inner container by the action of the desiccant. The water vapour-substantially impermeable outer container prevents ingress of water vapour from outside the package, and the intermediate space moreover acts as a desiccating barrier preventing any water vapour from passing from the exterior of the outer container of the package into the inner container.

The inner container may be a vial provided with a puncturable seal and or a syringe, or syringe barrel, suitable for use for transdermal injection of a formulation, and may be of generally similar overall construction to conventional known vials or syringes. However whereas in the case of conventional vials, syringes and syringe barrels materials are generally selected for the walls, stopper, plunger etc. which are highly impermeable to atmospheric water vapour, such as glass and specialised plastics and rubbers, in the present invention at least some such parts of the vial are made of materials which are water vapour-permeable. This enables the use of materials which although they are pharmaceutically acceptable in other respects and may be otherwise of excellent quality, are normally considered too water vapour-permeable for the containment of moisture-sensitive pharmaceutical products in a conventional vial or syringe where the vial or syringe is exposed to the ambient air.

The inner container is suitably a vial made from pharmaceutically acceptable water vapour-permeable plastics materials, having a puncturable rubber closure.

By the term "pharmaceutically acceptable" is included plastics materials which are known and acceptable for the containment of pharmaceutical substances, particularly substances for parenteral administration, by virtue of the relative inertness or impermeability of the material thereto. The term also includes plastics materials which would be acceptable for the containment of pharmaceutical substances except that they are normally considered too water vapour permeable for such use in the absence of an outer container.

Many such plastics materials are known, and examples of these include acrylics, cellulosics, nylons, polyethylene terephthalate, polyethylene, polypropylene, polystyrene and polyvinyls. Preferable other properties of the plastics material used are strength, visual clarity (although coloured or opaque plastic materials may be desirable for use with some light sensitive pharmaceutical substances), and the possibility of sterilisation for example by autoclaving or dry heat.

Additionally or alternatively the water vapour-permeability of the inner container may be via a water vapour permeable closure for an opening of the container. For example the closure may be a water vapour-permeable puncturable elastomeric seal for the mouth opening of a vial of the type mentioned above for a formulation for parenteral administration. Alternatively if the inner container is a syringe or syringe barrel the water vapour-permeability of an inner container in this form may be via a water vapour permeable closure for the nozzle or via a water vapour permeable elastomeric plunger for the syringe barrel. Known seals and plungers may be sufficiently water vapour permeable, or they may be specially made of such a water vapour permeable material such as a natural or synthetic rubber or other elastomer. Suitable elastomeric materials include natural rubbers, synthetic polyisoprene, butyl, halobutyl, nitrile, neoprene, silicone rubbers etc.

The use of such a water vapour permeable closure for an opening of the container may enable the walls of the inner container to be made of a pharmaceutically acceptable glass, e.g. borosilicate or soda-lime glass, a material which is frequently used for pharmaceutical vials, and which has the advantages of ease of sterilisation and optical clarity (although coloured or opaque glasses may be desirable for use with some light sensitive pharmaceutical substances), though being impermeable to water vapour.

The invention in this case takes advantage of a property of plastics material vials that would normally preclude their use for moisture sensitive products, i.e. their permeability, to provide long-term desiccation and stability enhancement.

Similarly, the glass vials are normally sealed with a moisture impermeable elastomer stopper, but a permeable disc seal would enable moisture to be removed from the vial contents by an external desiccant, without compromising the sterility of the product.

The use of 'standard' plastics material vials means that normal production processes and equipment can be used.

The relative permeability to water vapour of the inner container will depend inter alia upon the nature, surface area and thickness of the walls of the container and of the closure. A suitable thickness for the material of which the inner container is made may be determined by relatively straightforward experimentation for any intended contents. For example the extent of degradation of moisture sensitive contents within the inner container of a package of the invention can be measured, and the parameters of the package, e.g. materials, wall thickness etc. can be adjusted accordingly. It should be noted that the inner container is likely to benefit from the protection provided by the outer container, allowing a relatively thin inner walled inner container to be used.

The outer container may be made of any known packaging material which is substantially less permeable to water vapour than the inner container. The outer container is preferably completely impermeable to water vapour. Suitable packaging materials include metals, particularly in the form of thin foils such as aluminium and its alloys, or impermeable plastics materials, or plastics materials/metals laminates. The outer container may for example be in the form of a blister pack, i.e. a blister cavity formed in a first sheet of packaging material, and closed by a second sheet of packaging material across the open face of the cavity, with the inner container within the cavity. The first sheet may be deferrable and the second sheet may be easily torn, so that the vial can be forced through the second sheet by pressure on the blister.

Alternatively the outer container may be in the form of a tray or box, closed by a lid or in some other appropriate fashion, both the tray or box and the lid being made of the packaging material, with a substantially water vapour-impermeable seal formed between the lid and the box or tray. Alternatively the outer container may be in the form of a metal foil or foil/plastics material laminate envelope. Alternatively the outer container may be in the form of a container closed by a closure such as a screw cap or other form of conventional closure. Other forms of outer container will be apparent to those skilled in the art.

The nature of the outer container wall, and the disposition of the inner container within the outer container may be such that if the inner container is a vial with a puncturable seal for insertion of a hypodermic needle as described above, a hypodermic needle may be inserted through both the wall of the outer container, e.g. at a designated puncturable region therein, and through the seal, avoiding the need to remove the inner container from the outer container.

Whatever the form of the outer container, it is preferred that the shape of the outer container conforms closely to the shape of the inner container so that the intermediate space between the inner and outer containers is of relatively small volume, but sufficient to allow free circulation of air around the inner container and into contact with the desiccant material.

The nature and quantity of desiccant material used in the intermediate space between the inner and outer containers of the invention will vary with the nature of the walls and or the closure of the inner container, the nature of the contents of the inner container, and the nature of the outer container. The nature and quantity of desiccant material may easily be determined by straightforward experimentation, as described above, or calculation, with the aim of maintaining the RH within the inner container at a level at which a moisture sensitive material, such as a moisture sensitive pharmaceutical substance, is protected from hydrolytic degradation to the extent that long term storage with an acceptably small level of degradation can be achieved.

In the case of potassium clavulanate and its mixtures with amoxycillin, e.g. crystalline anhydrous sodium amoxycillin, molecular sieve is a suitable desiccant. Suitably the desiccant material may be compacted into a pellet, or contained in a permeable walled sachet, capsule or other container so that the desiccant remains in one place within the intermediate space. Methods of forming such compacts comprising desiccant materials are known, for example by compression, sintering, binders etc. Suitably the desiccant material may be retained in the intermediate space by the formation of a suitable holder or cavity in the outer container wall to hold the desiccant, or the provision of a connected compartment as in EP 0466068A. Suitably such a holder or cavity may hold the desiccant in a position remote from the puncturable seal of a vial of injectable formulation to avoid any risk of contamination of the contents of the vial by the desiccant in the intermediate space The container of the invention is particularly suitable for the containment of moisture-sensitive pharmaceutical substances such as a formulation of potassium clavulanate and sodium amoxycillin, particularly anhydrous crystalline sodium amoxycillin e.g. as disclosed in EP 0131147.

Moisture ingress through a typical outer container wall material such as an aluminium foil/plastics material laminate overwrap is typically 0.04 mg/day at 30° C./100% RH, i.e. 14.6 mg/year. Therefore for a three year shelf life a suitable moisture capacity for the desiccant to absorb this quantity of moisture is 44 mg. Typical batches of 700 mg of a mixture of potassium clavulanate and crystalline sodium amoxycillin pick up ca. 0.3% of free moisture if exposed at 25° C./25% RH i.e. 2.1 mg of water. Molecular sieve has a capacity of ca. 10% water capacity, and 44+2.1 mg of water can therefore be absorbed by ca. 500 mg of molecular sieve.

The water vapour transmission rate of a typical 20 ml polyethylene vial has been measured at 0.4 mg/day at 25° C./100% RH. Thus for an initial value of 25% RH inside the vial (e.g. resulting from filling the vial under such RH conditions) and effectively 0% RH inside the outer container, the initial drying rate will be 0.1 mg/day, dropping as the vial contents dry out and the differential water vapour pressure across the vial decreases. It can be calculated that the vial contents would reach 10% RH within 19 days at 25° C.

The contents of the inner container may be loaded into the inner container and the inner container then sealed, in an entirely conventional operation, suitably under dry sterile conditions, and the sealed inner container and desiccant material may then by sealed into the outer container, again in a generally conventional manner. Alternative methods of forming and filling the inner container may be used. For example a blow-fill-seal process may be used to blow a vial from hot molten plastics material, then fill it and seal it, in a continuous operation, the temperature of the hot melted plastics material ensuring sterility.

The invention further provides a package as described above, containing a mixture which comprises potassium clavulanate and sodium amoxycillin.

The invention also provides a method of storage of a moisture-sensitive pharmaceutical substance, particularly a pharmaceutical formulation for parenteral administration, comprising the containment of the substance in the inner container of a package of the invention.

The invention will now be described by way of example only with reference to the accompanying drawings, which are intended to be illustrative only of the invention, and not limiting.

FIG. 1 shows in a part cut away view a package of the invention in the form of a blister pack.

Figure 2:
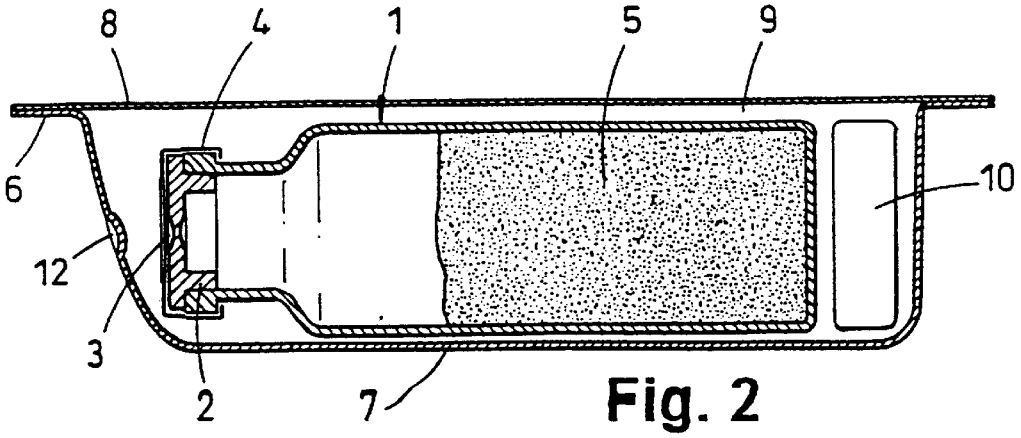
FIG. 2 shows a cross section through the package of FIG. 1 above, about the line A—A of FIG. 1.

FIG. 2 shows a cross section through the package of FIG. 1 about the line A—A of FIG. 1.

Referring to FIGS. 1 and 2 a package comprises an inner container in the form of a vial of conventional shape and of about 35 ml capacity (1) made of a plastics material which is permeable to water vapour but impermeable to atmospheric water vapour. The vial (1) is closed by a rubber seal (2) of generally known type having a thinned puncturable region (3) at its centre. The seal (3) is held in place by a small crimped metal retaining ring (4). The vial (1) contains a moisture sensitive pharmaceutical formulation (5) which can be made up with water for parenteral administration.

A suitable pharmaceutical formulation (5) comprises a coformulation of 500 mg of sodium amoxycillin, e.g. the crystalline anhydrous sodium amoxycillin disclosed in EP 0131147 A, and 100 mg of potassium clavulanate.

The vial (1-4) is located within a blister pack comprising a sheet of deformeable aluminium alloy foil/plastics material laminate (6) in which are formed blister cavities (7), closed by a thin backing sheet of aluminium alloy foil (8), sealed to the sheet (6) by means of an adhesive (not shown). The sheet (6) and the foil (8), and their sealing together are impermeable to water vapour.

The shape of the outer container (6,7,8) corresponds closely to the shape of the vial (1) so that the intermediate space (9) between the two is of relatively low volume whilst allowing free circulation of air around the vial (1).

Within the intermediate space (9) is a pellet of compacted desiccant material (10), being a molecular sieve. The pellet (10) is located in position within the blister (7) at a position remote from the seal (2) of the vial (1).

Further blister cavities (7A) are formed in adjacent positions in the sheet (6), and the region of the sheet (6) which includes them may be torn off for use at the perforated line (11) which delineates this region.

In use, the desiccant material (10) desiccates the intermediate space (9), and gradually removes water vapour from the interior of the vial (1) through its water vapour-permeable walls, so as to desiccate the interior of the vial and reduce or prevent hydrolytic degradation of the contents (5). The desiccated intermediate space (9) also serves as a desiccating barrier in case any water vapour should penetrate the outer container (6,7,8).

In use, the blister (7) may be deformed by pressure and the vial (1) thereby forced out through foil (8). The vial may then be used in the usual manner by insertion of a hypodermic needle (not shown) through the thinned region (3) and introduction of water or other suitable aqueous medium. Alternatively, a hypodermic needle may be inserted through the blister (7) at point (12), and then through the thinned region (3) without the need to first remove the vial (1) from the blister (7). To facilitate use of the package in this way the blister (7) may be provided with aligning guides such as dimples (not shown) in its walls to hold the vial (1) steady, and indication of a designated point (12), e.g. by a dimple for insertion of the needle.

In an alternative embodiment (not illustrated) the vial (1) may be replaced by a hypodermic syringe barrel made of water vapour permeable plastics materials.

In another alternative embodiment (not illustrated) the blister (7) may be replaced by a thin metal foil or metal foil plastics material laminate envelope which is impermeable to atmospheric water vapour.

Experimental Example 600 mg of a mixture of crystalline sodium amoxycillin and potassium clavulanate, being a 5:1 weight ratio of sodium amoxycillin:potassium clavulanate (expressed as the free acid equivalent) was filled into 10 ml or 20 ml plastic vials made by Daikyo™ from a hydrocarbon polymer called CZ Resin. Such a mixture is suitable for use as an injectable formulation. The vials were divided into four groups, sealed into a moisture-impermeable aluminium foil laminate pouch with desiccant capsules and stored at controlled temperatures.

| Group: | Contents |
|---|---|
| A | 10 ml vials, packed with 1.25 g molecular sieve |
| B | 10 ml vials, packed with 2.5 g molecular sieve |
| C | 10 ml vials, no desiccant |
| D | 20 ml vials, packed with 1.25 g molecular sieve |

Degradation of the vials contents was assessed by measuring the colour of the powder, this having been demonstrated as a very sensitive technique. An increase in the yellow component of the appearance is directly related to generation of degradation products and loss of potency of the active material. Results are set out below:

| Vials stored at 40° C. | | | | |
|---|---|---|---|---|
| Time(months) | A | B | C | D |
| 0 | | 5.1 | | |
| 1 | 8.9 | 8.7 | 9.7 | 8.3 |
| 9 | 10.7 | 11.0 | 14.1 | 9.6 |

| Vials stored at 25° C. | | | |
|---|---|---|---|
| Time (months) | A | C | D |
| 0 | | 5.1 | |
| 9 | 7.8 | 12.8 | 8.4 |

The values quoted are the 'b' value of the L,a,b colour space, a measure of yellowness.

The initial degradation of all the groups at one month was probably from the small but significant amounts of water in the plastic of the vial, which has to be taken up by the desiccant before drying can start on the vial contents. Predesiccation of the components and careful handling will minimise these losses.

As can be seen from the accompanying data, the water vapour transmission rate of glass vials with a rubber stopper is very low, while that of the Daikyo™ vials is similar to a typical polyethylene product. Typical water vapour transmission rates are:

5 ml glass vials sealed with standard stopper and aluminium seal=0.01 mg/day @ 30°/100% R.H.

20 ml Daikyo™ vials sealed with standard stopper and aluminium seal=0.46 mg/day @ 30°/100% R.H.

20 ml polyethylene vials sealed with standard stopper and aluminium seal=0.40 mg/day @ 30°C./100% R.H.

We claim:

1. A package comprising an inner container, the inner container being enclosed within an outer container which is substantially less permeable to water vapour than the inner container, the intermediate space between the inner and outer containers containing a desiccant, wherein the inner container is a vial provided with a puncturable seal, or a syringe or syringe barrel, suitable for use for transdermal injection of a formulation, and being permeable to water vapour but impermeable to liquid water, the inner container containing a pharmaceutical formulation being a mixture which comprises potassium clavulanate and anhydrous crystalline sodium amoxycillin.

2. A package comprising an inner container containing a pharmaceutical formulation, the inner container being enclosed within an outer container which is substantially less permeable to water vapour than the inner container, the intermediate space between the inner and outer containers containing a desiccant, wherein the inner container is a vial provided with a puncturable seal, or a syringe or syringe barrel, suitable for use for transdermal injection of a formulation, the inner container being permeable to water vapour but impermeable to liquid water and made from pharmaceutically acceptable water vapour-permeable plastic materials; and wherein the pharmaceutical formulation comprises potassium clavulanate and sodium amoxycillin.

3. A package according to claim 2 wherein the water vapour-permeable plastic material is selected from the group consisting of acrylics, cellulosics, nylons, polyethylene terephthalate, polyethylene, polypropylene, polystyrene, polyvinyls and hydrocarbon polymers.

4. A package according to claim 2 wherein the outer container is in the form of a blister pack.

5. A package according to claim 2 wherein the outer container is in the form of a tray or box closed by a lid, both the tray or box and the lid being made of the packaging material, with a substantially water vapour-impermeable seal formed between the lid and the box or tray, or a metal foil or foil/plastics material laminate envelope.

6. A package according to claim 2 wherein the sodium amoxycillin is in the form of an anhydrous crystalline amoxycillin.

7. A method of storage of a moisture-sensitive pharmaceutical substance, comprising the containment of the substance in the inner container of a package according to claim 2.

8. A package comprising an inner container containing a pharmaceutical formulation, the inner container being enclosed within an outer container which is substantially less permeable to water vapour than the inner container, the intermediate space between the inner and outer containers containing a desiccant, wherein the inner container is a vial provided with a puncturable region suitable for use for injection of a formulation, the inner container being permeable to water vapour but impermeable to liquid water and made from pharmaceutically acceptable water vapour-permeable plastic materials; said outer container in the form of a blister pack, said blister pack having an indication of a designated point for insertion of a hypodermic needle through said blister pack wall and through said puncturable region of said vial via which water or an aqueous medium may be injected into said vial for dissolution of the contents of the vial and subsequent withdrawal of the so-formed solution.

9. A package according to claim 8 wherein the water vapour-permeable plastic material is selected from the group consisting of acrylics, cellulosics, nylons, polyethylene terephthalate, polyethylene, polypropylene, polystyrene, polyvinyls and hydrocarbon polymers.

10. A package according to claim 8 wherein the outer container is in the form of a tray or box closed by a lid, both the tray or box and the lid being made of the packaging material, with a substantially water vapour-impermeable seal formed between the lid and the box or tray, or a metal foil or foil/plastics material laminate envelope.

11. A package according to claim 8 wherein the pharmaceutical formulation comprises potassium clavulanate and sodium amoxycillin.

12. A package according to claim 11 wherein the sodium amoxycillin is in the form of an anhydrous crystalline amoxycillin.

13. A method for stabilizing a pharmaceutical moisture sensitive formulation which method comprises placing the pharmaceutical formulation in a suitable inner container of a water vapour permeable plastic material which container is enclosed within an outer container which is substantially less permeable to water vapour than the inner container, which is substantially less permeable to water vapour than the inner container, the intermediate space between the inner and outer containers containing a desiccant, wherein the inner container is a vial provided with a puncturable seal, or a syringe or syringe barrel, suitable for use for transdermal injection of the formulation, the inner container being permeable to water vapour but impermeable to liquid water and made from pharmaceutically acceptable water vapour-permeable plastic materials; and wherein the pharmaceutical formulation comprises potassium clavulanate and sodium amoxycillin.

14. The method according to claim 13 wherein the water vapour-permeable plastic material is selected from the group consisting of acrylics, cellulosics, nylons, polyethylene terephthalate, polyethylene, polypropylene, polystyrene, polyvinyls and hydrocarbon polymers.

15. The method according to claim 13 wherein the outer container is in the form of a tray or box closed by a lid, both the tray or box and the lid being made of the packaging material, with a substantially water vapour-impermeable seal formed between the lid and the box or tray, or a metal foil or foil/plastics material laminate envelope.

16. A method according to claim 13 wherein the sodium amoxycillin is in the form of an anhydrous crystalline amoxycillin.

* * * * *